US007899370B2

(12) United States Patent
Nakajima

(10) Patent No.: US 7,899,370 B2
(45) Date of Patent: Mar. 1, 2011

(54) TONER CONTAINER

(75) Inventor: Takehiro Nakajima, Kyoto (JP)

(73) Assignee: Murata Machinery, Ltd., Kyoto (JP)

( * ) Notice: Subject to any disclaimer, the term of this patent is extended or adjusted under 35 U.S.C. 154(b) by 82 days.

(21) Appl. No.: 12/425,425

(22) Filed: Apr. 17, 2009

(65) Prior Publication Data

US 2009/0285604 A1 Nov. 19, 2009

(30) Foreign Application Priority Data

May 15, 2008 (JP) ..... 2008-128759

(51) Int. Cl.
*G03G 15/08* (2006.01)

(52) U.S. Cl. ..... 399/258; 399/260; 399/262

(58) Field of Classification Search ..... 399/119, 399/120, 252, 258, 260, 262; 222/DIG. 1
See application file for complete search history.

(56) References Cited

U.S. PATENT DOCUMENTS

| | | | | |
|---|---|---|---|---|
| 6,785,497 | B1 * | 8/2004 | Hasebe | 399/260 |
| RE40,021 | E * | 1/2008 | Ise et al. | 399/262 |
| 2002/0044795 | A1 | 4/2002 | Kato | |

FOREIGN PATENT DOCUMENTS

| | | | |
|---|---|---|---|
| JP | 01-064661 | U | 4/1989 |
| JP | 09-502536 | A | 3/1997 |
| JP | 2002-123074 | A | 4/2002 |
| JP | 2003-255684 | A | 9/2003 |
| JP | 2007-052287 | A | 3/2007 |
| WO | 95/00886 | A1 | 1/1995 |

OTHER PUBLICATIONS

Official Communication issued in corresponding Japanese Patent Application No. 2008-128759, mailed on Feb. 16, 2010.

* cited by examiner

*Primary Examiner* — Hoan Tran
(74) *Attorney, Agent, or Firm* — Keating & Bennett, LLP

(57) ABSTRACT

A toner cartridge includes a cylindrical supplying pipe having a toner opening port arranged on a side surface thereof; a cylindrical cover that is attached to the supplying pipe and has a cover opening port arranged on a side surface thereof, and a cam mechanism that is provided to the supplying pipe and the cover, and that reciprocates the cover between an opening position where the toner opening port and the cover opening port align with each other and a closing position where the toner opening port is closed by the cover, which closing position is in a skewed position with respect to the opening position. This arrangement provides a toner container that reduces toner leakage when being removed from a toner hopper.

9 Claims, 5 Drawing Sheets

TONER CONTAINER

CROSS-REFERENCE TO RELATED APPLICATIONS

This application claims priority under 35 U.S.C. 119 to Japanese Patent Application No. 2008-128759, filed on May 15, 2008, which application is hereby incorporated by reference in its entirety.

BACKGROUND OF THE INVENTION

1. Field of the Invention

The present invention relates to a toner container that is removably provided in an image forming device.

2. Description of the Related Art

A conventional facsimile machine, copier, printer, or the like, includes an image forming device, and toner supplied to a developing unit of the image forming device is contained in a toner container. The toner container has a toner supplying port arranged to supply the toner. The toner supplying port is covered by an openable and closable cover. The toner container is removably provided to a toner hopper.

The conventional art discloses, for example, a toner container provided with a cylindrical cover which is attached thereto and reciprocated along an axial direction of a cylindrical removing portion. In such a conventional configuration, when the toner container is attached to the toner hopper the toner supplying port opens, and when the toner container is removed from the toner hopper, the toner supplying port closes.

When removing the toner container from the toner hopper, the toner may leak from the toner supplying port and soil the inside of a device body. Therefore, it is necessary to prevent toner leakage when removing the toner container from the toner hopper. However, in the above conventional toner container, since the cover moves linearly with respect to the removing portion, the toner supplying port cannot be closed without leaking the toner that remains around the toner supplying port. In particular, in a second-half operation of closing the cover, the cover pushes out the toner that remains in the vicinity of the toner supplying port.

SUMMARY OF THE INVENTION

In order to overcome the problems described above, preferred embodiments of the present invention provide a toner container that reduces toner leakage at the time of removing the toner container from a toner hopper.

According to a preferred embodiment of the present invention, a toner container includes a cylindrical supplying pipe, a cylindrical cover, and a cam mechanism. The supplying pipe has a toner opening port on a side surface thereof. The cover is attached to the supplying pipe and has a cover opening port on a side surface thereof. The cam mechanism is provided to the supplying pipe and the cover to reciprocate the cover between an opening position where the toner opening port and the cover opening port match to each other and a closing position where the toner opening port is closed by the cover. The closing position is in a skewed position with respect to the opening position.

In the toner container according to another preferred embodiment of the present invention, the cam mechanism includes a plurality of supplying pipe side cams arranged on an outer circumferential surface of the supplying pipe in a circumferential direction and a plurality of cover side cams arranged on an inner circumferential surface of the cover in a circumferential direction to engage with the respective supplying pipe side cams.

According to another preferred embodiment of the present invention, the toner container includes an elastic body arranged to bias the cover towards the closing position.

The advantages of various preferred embodiments of the present invention will now be described.

Since the cover is reciprocated by the cam mechanism between the opening position and the closing position, which is skewed with respect to the opening position, when closing the toner supplying port, the cover moves from the opening position to the closing position while spirally rotating. Thus, the cover can close the toner opening port while scooping up the toner remained around the toner supplying port. As a result, toner leakage that may occur when the toner container is removed from the toner hopper can be reduced.

The cam mechanism may preferably have a simple shape and configuration. Moreover, by providing two cams, the cover can reliably be reciprocated between the opening position and the closing position.

After the toner supplying port is closed, the toner supplying port will remain steadily closed due to a biasing force of the elastic body. Therefore, the toner leakage can be reliably prevented even after the toner container is removed from the toner hopper.

Other features, elements, processes, steps, characteristics and advantages of the present invention will become more apparent from the following detailed description of preferred embodiments of the present invention with reference to the attached drawings.

DETAILED DESCRIPTION OF THE PREFERRED EMBODIMENTS

Figure 1:
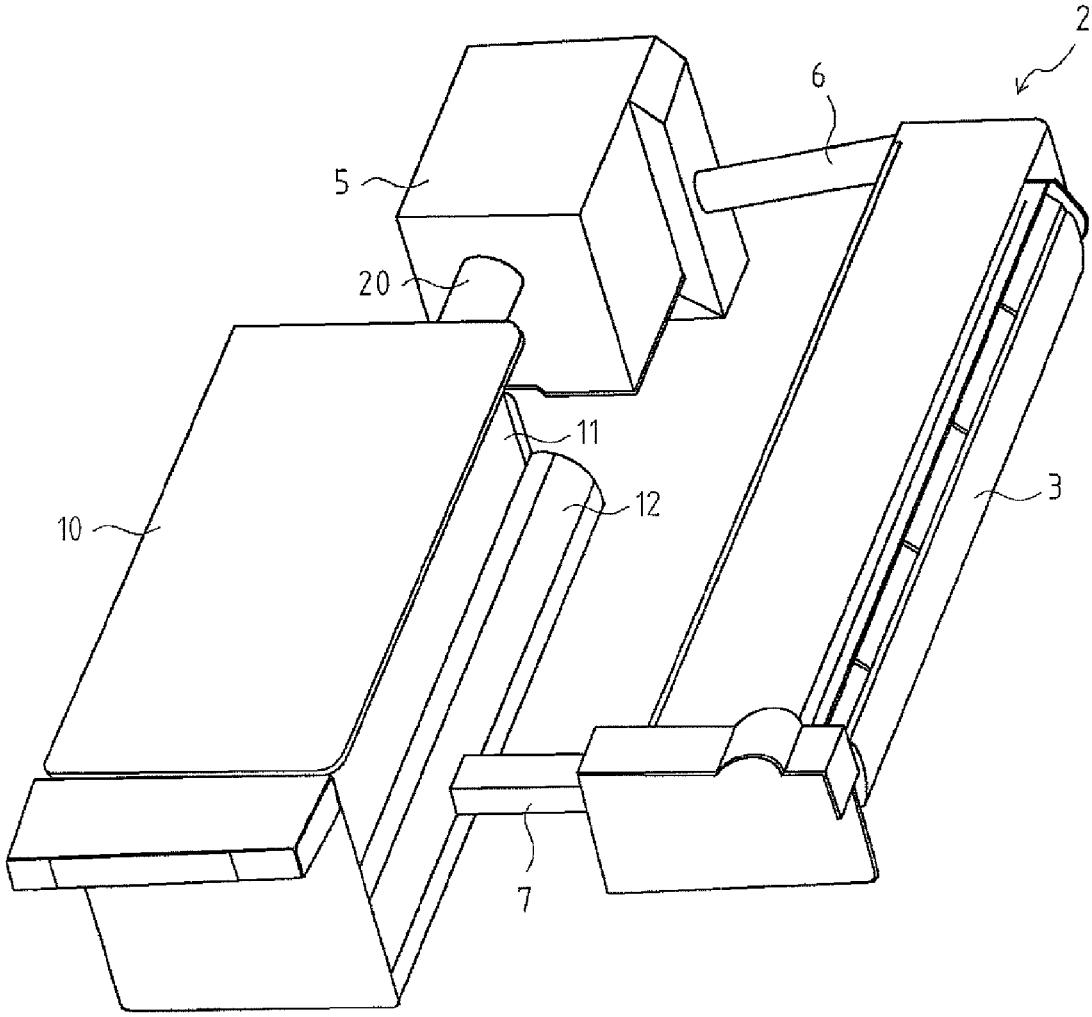
FIG. 1 is a perspective view illustrating a state in which a developing unit, a toner hopper, and a toner container of an image forming device according to a preferred embodiment of the present invention are connected with each other.
Figure 2:
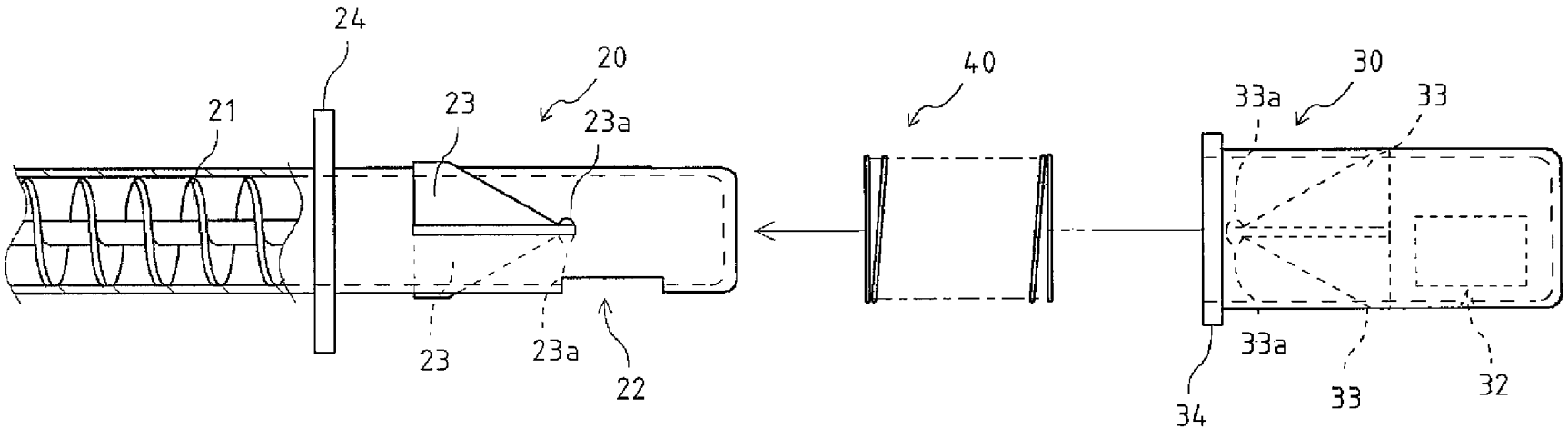
FIG. 2 is a side view illustrating a portion of a supplying pipe in a sectional view according to a preferred embodiment of the present invention.
Figure 3A:
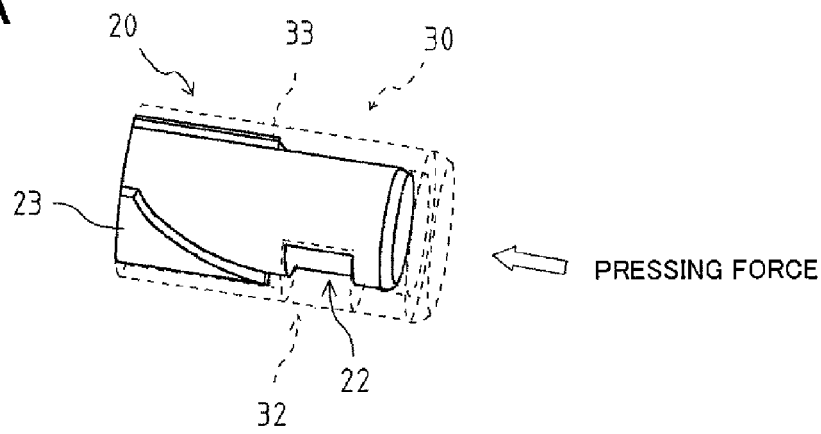
FIGS. 3A, 3B, and 3C are perspective views of portions schematically illustrating a cover opening and closing operation according to a preferred embodiment of the present invention.
Figure 3B:
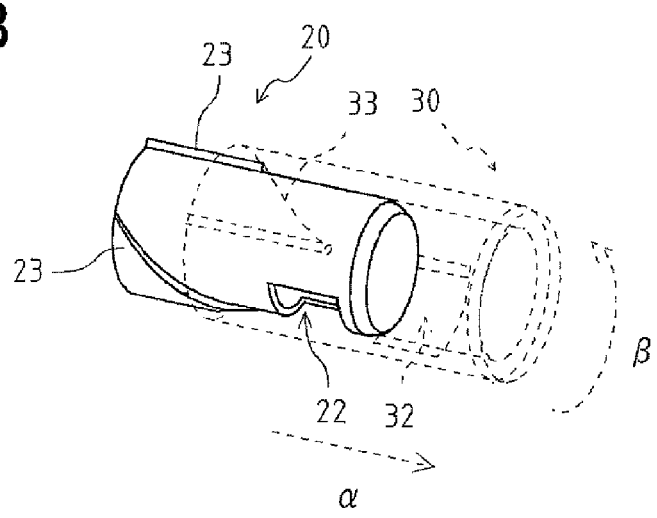
Figure 3C:
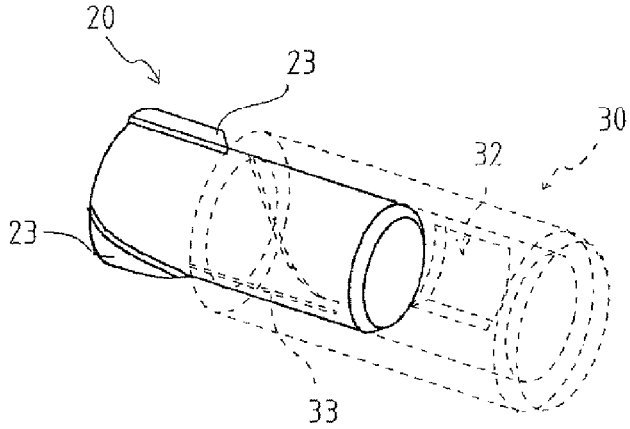
Figure 4A:
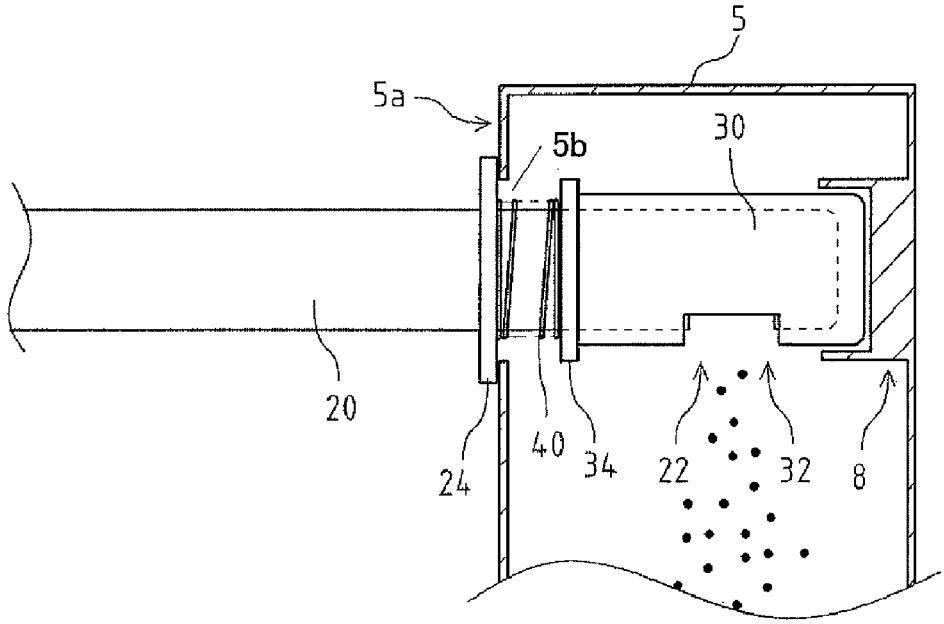
FIGS. 4A and 4B are side views of portions schematically illustrating a state in which the toner container is attached to the toner hopper according to a preferred embodiment of the present invention.
Figure 4B:
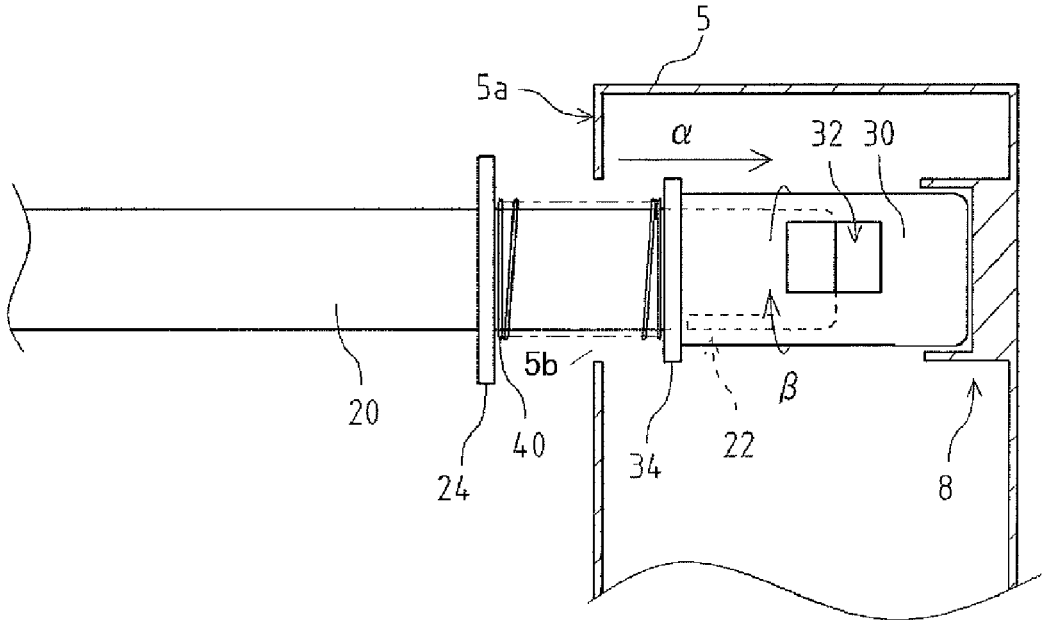
Figure 5A:
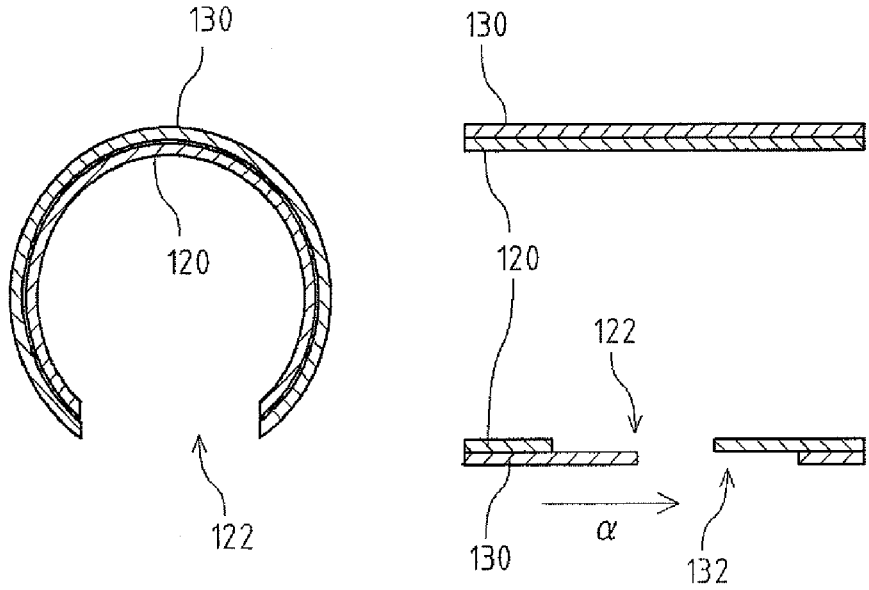
FIG. 5A Prior Art
FIGS. 5A and 5B are sectional views illustrating a comparison between a cover according to a preferred embodiment of the present invention and a cover according to a conventional art.
Figure 5B:
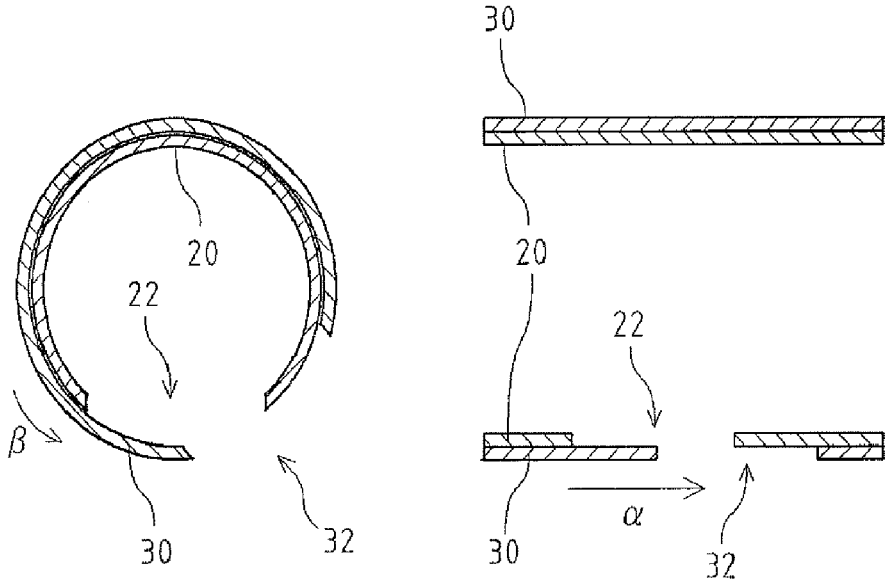

Preferred embodiments of the present invention will be described. FIG. 1 is a perspective view illustrating a state in which a developing unit 2, a toner hopper 5, and a toner cartridge 10 of an image forming device according to a preferred embodiment of the present invention are connected with each other. FIG. 2 is a side view illustrating a portion of a supplying pipe 20 in a sectional view. FIG. 3 is a perspective view of portions schematically illustrating an operation of opening and closing a cover 30. FIGS. 4A and 4B are side views of portions schematically illustrating a state in which the toner cartridge 10 is attached to the toner hopper 5. FIGS. 5A and 5B are sectional views illustrating a comparison between the cover of the present preferred embodiment (FIG. 5B) and a cover 130 of a conventional art (FIG. 5A).

A configuration of the developing unit 2 including the toner cartridge 10 provided as a toner container according to a preferred embodiment of the present invention will now be described. The toner cartridge 10 is removably attached to the image forming device of a printer. The image forming device according to a preferred embodiment of the present invention may be a multifunctional peripheral, such as a copier, or a facsimile machine, for example. It may have other functions in addition to a printer function as long as the device has the printer function.

As illustrated in FIG. 1, a photoconductive drum 3 is rotatably provided to the developing unit 2. Toner supplied to the developing unit 2 is recorded on an outer circumferential surface of a not-illustrated developing roller by the developing roller and a not-illustrated supplying roller, etc. Then, the toner is adhered to an electrostatic latent image formed on an outer circumferential surface of the photoconductive drum 3 and forms an image. Further, a paper is transported between the photoconductive drum 3 and a transfer roller opposing the photoconductive drum 3. When a transfer bias is applied to the transfer roller, the toner moves to a surface side of the paper, and a toner image is transferred to the paper. The paper having the transferred toner image is fixed by being heated and pressed by a fixing unit, and an image is formed on the surface of the paper.

The toner cartridge 10 is connected to the developing unit 2. The toner cartridge 10 includes an unused-toner containing unit 11 arranged to contain unused toner and a waste-toner collecting unit 12 arranged to collect the used waste toner.

The unused-toner containing unit 11 is connected to the toner hopper 5 via the supplying pipe 20. The toner hopper 5 is a container which can store a prescribed amount of toner. The unused toner in the toner cartridge 10 is transported from the unused-toner containing unit 11 to the toner hopper 5 through the supplying pipe 20.

The toner hopper 5 is connected to the developing unit 2 via a pipe 6. The unused toner stored in the toner hopper 5 is transported from the toner hopper 5 to the developing unit 2 through the pipe 6.

The waste-toner containing unit 12 is connected with the developing unit 2 via a pipe 7. The waste toner scraped from the outer circumferential surface of the photoconductive drum 3 by a photosensitive brush is transported from the developing unit 2 to the waste-toner containing unit 12 via the pipe 7.

The supplying pipe 20 will now be described in detail. As illustrated in FIG. 2, a cover 30 is attached to a leading edge portion of the supplying pipe 20 through the intermediary of a spring 40 provided as an elastic body. It should be noted that it is also possible to use any other type of elastic body, if so desired. In order to simplify the description, FIG. 2 separately illustrates the supplying pipe 20, the spring 40, and the cover 30.

The supplying pipe 20 preferably has a cylindrical shape and includes inside the pipe 20 a screw member 21 that defines a spiral screw piece on an outer circumferential surface thereof. A toner opening port 22, supplying pipe side cams 23, and a flange 24 are arranged on an outer circumferential side surface of the supplying pipe 20. The toner opening port 22 is arranged in the vicinity of a leading edge of the supplying pipe 20. In the present preferred embodiment, the toner opening port 22 preferably opens in a rectangular shape, but is not limited to a specific opening shape. The supplying pipe side cams 23 define a cam mechanism and are arranged on a side of the unused-toner containing unit 11 beyond the toner opening port 22. The supplying pipe side cams 23 are disposed at positions in a circumferential direction of the supplying pipe 20, one of the positions being out of phase with the other by about 180 degrees, for example. Each of the supplying pipe side cams 23 has a spiral protruding portion on one side thereof along an outer circumferential surface of the supplying pipe 20. A portion protruding in a circular ring shape from the supplying pipe 20 defines the flange 24, which is arranged on the side of the unused-toner containing unit 11 beyond the supplying pipe side cams 23.

The cover 30 preferably is a cylindrical pipe and includes a cover opening port 32 on a side surface thereof, cover side cams 33 on an inner circumferential side thereof, and a flange 34 on an outer circumferential side thereof. In the present preferred embodiment, the cover opening port 32 preferably opens in a rectangular shape, but is not limited to a specific opening shape. An opening shape of the cover opening port 32 is preferably identical or substantially similar to that of the toner opening port 22. The cover side cams 33 define a cam mechanism and are arranged on the side of the unused-toner containing unit 11 beyond the cover opening port 32. Each of the cover side cams 33 also has a spiral protruding portion on one side, each of the spiral protruding portions arranged to be engaged with the respective spiral protruding portions of the supplying pipe side cams 23 when attached to the supplying pipe 20. A portion protruding in a circular ring shape from the cover 30 defines the flange 34, which is arranged at a trailing edge which is on the side of the unused-toner containing unit 11 beyond the cover side cams 33. The flange 24 is greater in size than the flange 34.

Retaining portions 23*a* are protrusions arranged at respective leading edge sides of the supplying pipe side cams 23 and 23. Retaining portions 33*a* are protrusions arranged at respective trailing edge sides of the cover side cams 33. The cover 30 is biased by the spring 40 in a direction departing from the supplying pipe 20, however, when the retaining portions 23*a* engage with the retaining portions 33*a*, the cover 30 is prevented from being removed from the supplying pipe 20 at a closing position to be described later.

The spring 40 has a function of biasing the supplying pipe 20 as a compression spring in an axial direction and a function of biasing the supplying pipe 20 as a torsion spring in the axial direction. The spring 40 is locked by the flange 34 of the cover 30 and the flange 24 of the supplying pipe 20. In this state, the spring 40 biases in a direction in which the cover 30 departs from the supplying pipe 20 with respect to the axial direction, and the spring 40 also biases in a direction in which the supplying pipe side cams 23 engage with the cover side cams 33 with respect to the circumferential direction.

The actions of the supplying pipe side cams 23 and of the cover side cams 33 will now be described in detail. As illustrated in FIG. 3A, when a pressing force is applied with respect to the cover 30 in a direction of the unused-toner containing unit 11 from the leading edge side of the supplying pipe 20, the cover 30 moves in response to the pressing force while spirally rotating in the direction of the unused-toner containing unit 11. Then, with respect to the supplying pipe 20, the cover 30 comes to an opening position where the toner opening port 22 and the cover opening port 32 match to each other to open the toner opening port 22. As illustrated in FIG. 3B, when the pressing force applied in the direction of the unused-toner containing unit 11 from the leading edge side of the supplying pipe 20 is gradually released, the cover 30 moves in a direction of arrow $\alpha$ relatively with respect to the supplying pipe 20 in response to a biasing force of the spring 40 applied in the axial direction. At the same time, in response to a biasing force of the spring 40 applied in the circumferential direction, the cover 30 moves in a direction of arrow β in which the cover side cams 33, 33 engage with the respective supplying pipe side cams 23. As illustrated in FIG. 3C, the cover 30 moves while spirally rotating, and the retaining portions 23*a* engage with the respective retaining portions 33*a*. In this state, with respect to the supplying pipe 20, the cover 30 comes to a closing position where the toner opening port 22 of the supplying pipe 20 is closed by the cover 30. With this configuration, the opening position establishes a skewed positional relationship with the closing position. In order to simplify FIGS. 3A, 3B, and 3C, the cover 30 is illustrated in a perspective view, and illustrations of the spring 40, the retaining portions 23*a* and 33*a* are omitted.

A process of removing the toner cartridge 10 from the image forming device will now be described in detail. FIG. 4A illustrates a situation where the toner cartridge 10 is attached to the image forming device. In FIG. 4A, when the supplying pipe 20 is attached to the toner hopper 5, an attaching portion 8 makes contact with the cover 30. As a result, the pressing force is applied to the cover 30 in the direction of the unused-toner containing unit 11. Thus, the cover 30 comes to the opening position with respect to the supplying pipe 20. At this time, in the supplying pipe 20, the flange 24 makes contact with the outside of a toner hopper opening port side surface 5*a*, and the toner cartridge 10 and the toner hopper 5 are connected with each other.

FIG. 4B illustrates a situation where the toner cartridge 10 is removed from the image forming device. In FIG. 4B, the pressing force against the cover 30 is released when the supplying pipe 20 is removed from the toner hopper 5. At this time, the cover 30 moves in the direction of arrow α relatively with respect to the supplying pipe 20 in response to the biasing force of the spring 40 applied in the axial direction. At the same time, the supplying pipe side cams 23 are engaged with the respective cover side cams 33 by the biasing force of the spring 40 applied in the circumferential direction, and the cover 30 moves in the direction of arrow β in the circumferential direction. In other words, the cover 30 moves from the opening position to the closing position while rotating spirally, and the toner opening port 22 is closed by the cover 30. In FIGS. 4A and 4B, for easier understanding of explanation, the illustrations of the supplying pipe side cams 23 and the cover side cams 33 are omitted. An opening port 5*b* of the toner hopper 5 is greater than the flange 34 and smaller than the flange 24 in size. Accordingly, when attaching the toner cartridge 10 to the toner hopper 5, the flange 34 can be easily inserted into the toner hopper 5 through the opening port 5*b*, and the flange 24 is positioned by the opening port 5*b*. The flange 24 locks the spring 40 and is positioned with respect to the toner hopper 5.

Some advantages of the present preferred embodiment over the conventional art will now be described. As illustrated in FIGS. 5A and 5B, the present preferred embodiment of the present invention and the conventional art will be compared with reference to the sectional views of the toner opening ports 22 and 122 in the axial direction and in the circumferential direction.

As illustrated in FIG. 5A, in the conventional art, when closing the toner opening port 122, a cover 130 and a cover opening port 132 linearly move in a direction of arrow α in the axial direction with respect to a supplying pipe 120. As a result, when closing the cover 130, the toner opening port 122 cannot be closed without leaking toner remaining around the toner opening port 122. In particular, in a second-half operation of closing the cover 130, the cover 130 pushes out the residual toner remaining around the toner opening port 122.

As illustrated in FIG. 5B, in the present preferred embodiment of the present invention, when closing the toner supplying port 22, the cover 30 moves from the opening position to the closing position in the direction of arrow α in the axial direction and in the direction of arrow β in the circumferential direction, as previously described. In other words, the cover 30 moves from the opening position to the closing position while spirally rotating. As a result, the cover 30 can close the toner opening port 22 while scooping up the toner remained around the toner supplying port 22. Thus, the toner leakage at the time of removing the toner cartridge 10 from the toner hopper 5 can be minimized.

Further, the cam mechanism can be configured with a simple cam shape which is defined by the supplying pipe side cams 23 and the cover side cams 33. Furthermore, by providing two cams on the supplying pipe side and on the cover side, respectively, the cover 30 can be reliably reciprocated between the opening position and the closing position. Moreover, after the toner cartridge 10 is removed from the toner hopper 5, since the toner opening port 22 is reliably closed by the cover 30 due to the biasing force of the spring, the toner leakage can be reliably prevented even after the toner cartridge 10 is removed from the toner hopper 5.

The present invention is not limited to the toner cartridge 10 arranged to supply toner but can be applied, with similar advantages, to other toner containers that are removably provided to image forming devices, such as a connection portion etc. arranged between a waste toner box and an image forming device.

While the present invention has been described with respect to preferred embodiments thereof, it will be apparent to those skilled in the art that the disclosed invention may be modified in numerous ways and may assume many embodiments other than those specifically set out and described above. Accordingly, the appended claims are intended to cover all modifications of the present invention that fall within the true spirit and scope of the present invention.

What is claimed is:

1. A toner container comprising:

a cylindrical supplying pipe including a toner opening port arranged on a side surface thereof;

a cylindrical cover that is attached to the supplying pipe and includes a cover opening port arranged on a side surface thereof; and a cam mechanism that is provided to the supplying pipe and the cover and is arranged to reciprocate the cover between an opening position where the toner opening port substantially aligns with the cover opening port and a closing position where the toner opening port is closed by the cover, such that the cover opening port in the closing position is arranged in a skewed position with respect to the cover opening port in the opening position; wherein the cam mechanism includes a plurality of supplying pipe side cams arranged on an outer circumferential surface of the supplying pipe in a circumferential direction, and a plurality of cover side cams arranged on an inner circumferential surface of the cover in a circumferential direction to engage with the respective supplying pipe side cams.

2. The toner container according to claim 1, comprising an elastic body arranged to bias the cover towards the closing position.

3. The toner container according to claim 2, wherein the elastic body is held between the supplying pipe and the cover.

4. The toner container according to claim 3, wherein each of the supplying pipe and the cover includes a flange; and the elastic body is held between the flanges.

5. The toner container according to claim 4, wherein the flange of the supplying pipe is greater in size than the flange of the cover.

6. The toner container according to claim 1, wherein each of the supplying pipe and the cover includes a retaining portion; and the retaining portions are engaged with each other.

7. The toner container according to claim 1, wherein a shape of the toner opening port is substantially similar to a shape of the cover opening port.

8. An image forming device comprising the toner container of claim 1.

9. The image forming device according to claim 8, comprising a toner hopper; wherein an opening port of the toner hopper is greater in size than a flange of the cover and smaller in size than a flange of the supplying pipe.

* * * * *